US005799523A

United States Patent [19]

Seidel et al.

[11] Patent Number: 5,799,523

[45] Date of Patent: Sep. 1, 1998

[54] DEVICE FOR INFLUENCING THE PROFILE OF ROLLED STRIP

[75] Inventors: Jürgen Seidel, Kreuztal; Rüdiger Holz, Neunkirchen; Klaus Klamma, Hilchenbach; Hans-Joachim Pölking, Kreuztal, all of Germany

[73] Assignee: SMS Schloemann-Siemag Aktiengesellschaft, Düsseldorf, Germany

[21] Appl. No.: 754,587

[22] Filed: Nov. 19, 1996

[30] Foreign Application Priority Data

Nov. 20, 1995 [DE] Germany ..... 195 43 168.5

[51] Int. Cl.[6] ..... B21B 27/10

[52] U.S. Cl. ..... 72/9.3; 72/201

[58] Field of Search ..... 72/201, 7.6, 9.1, 72/9.3, 342.3, 236, 11.7, 11.8, 11.9

[56] References Cited

U.S. PATENT DOCUMENTS

| | | | |
|---|---|---|---|
| 4,467,629 | 8/1984 | Schimion | 72/201 |
| 4,644,774 | 2/1987 | Van Steden | 72/201 |
| 4,706,480 | 11/1987 | Svatos | 72/201 |

FOREIGN PATENT DOCUMENTS

| | | | |
|---|---|---|---|
| 0542640 | 5/1993 | European Pat. Off. . | |
| 329520 | 12/1993 | Japan | 72/201 |

OTHER PUBLICATIONS

Patent Abstracts of Japan, vol. 012, No. 010 (M–658), Jan. 13, 1988 & JP 62 173017 A (Kobe Steel Ltd), Jul. 29, 1987.

Soviet Inventions Illustrated, Section Ch, Week 36, Oct. 15, 1980 & SU 710 705 A (Control Problems), Jan 25, 1980.

Patent Abstracts of Japan, vol. 010, No. 273 (M–518), Sep. 17, 1986 & JP 61 095710 A (Kobe Steel Ltd), May 14, 1986.

*Primary Examiner*—Lowell A. Larson

*Attorney, Agent, or Firm*—Friedrich Kueffner

[57] ABSTRACT

A device for influencing the profile of strip rolled in at least one roll stand includes adjusting units, bending units and possibly displacement units for the stand and spray beams adjacent the rolls of the stand for spraying cooling agent and/or lubricating agent onto the rolls, if necessary, in a controlled manner; the device further includes a regulating unit. Additional spray beams are provided adjacent the two end portions of the body of each roll, wherein the effective range of each additional spray beam extends from the respective end of the body of the roll into the area of the strip edge facing this end of the body of the roll.

13 Claims, 7 Drawing Sheets

DEVICE FOR INFLUENCING THE PROFILE OF ROLLED STRIP

BACKGROUND OF THE INVENTION

1. Field of the Invention

The present invention relates to a device for influencing the profile of strip rolled in at least one roll stand. The device includes adjusting units, bending units and possibly displacement units for the stand and spray beams adjacent the rolls of the stand for spraying cooling agent and/or lubricating agent onto the rolls, if necessary, in a controlled manner; the device further includes a regulating unit.

2. Description of the Related Art

When strip is cold rolled, different loads occur in the strip edge areas as compared to the middle portion of the strip, wherein the different loads negatively influence the constancy of the thickness of the strip over its width. In addition to the thermal crown produced over the width of the rolls and the increased wear of the rolls in the edge areas of the strip which would cause a thicker edge profile as compared to the strip middle, a significant thickness drop in the edge area is caused primarily by the transverse flow behavior of the material in the direction of the width of the strip.

During cold rolling, the additional wear in the edge area is small and the thermal crown is compensated for the most part by cooling of the rolls in the middle portion thereof, so that the transverse flow behavior of the material produces the so-called edge drops, i.e., the strip edge profiles which are thinner toward the strip middle.

SUMMARY OF THE INVENTION

Therefore, it is the primary object of the present invention to minimize or even entirely eliminate the edge drops without significantly disadvantageously influencing the strip tension distribution.

In accordance with the present invention, additional spray beams are provided adjacent the two end portions of the body of each roll, wherein the effective range of each additional spray beam extends from the respective end of the body of the roll into the area of the strip edge facing this end of the body of the roll.

The additional spray beams are capable of additionally and more strongly cooling the roll bodies as necessary in the strip edge areas. The roll diameters in the strip edge areas are reduced by the additional cooling which, in turn, results in an increase of the roll gap. This counteracts the edge drop caused by the transverse flow behavior of the material.

The additional spray beams provided in accordance with the present invention are usually only provided for the work rolls because the work rolls are subjected to the greatest thermal loads as a result of the rolling work and the contact with the rolling stock.

If the additional spray beams are arranged on the entry side and/or the exit side of the stand, it is possible to achieve a substantially greater cooling of the end portions of the roll bodies. In addition, an optimum adjustment of the additional spray beams can be selected.

If the spray nozzles of the additional spray beams have a spray direction directed toward the roll body ends, it is ensured that the spray medium is sprayed away from the roll middle and, thus, away from the strip middle, so that no additional unintended cooling occurs in this area.

It is useful to adapt the spray width of the additional spray beams to the strip width, so that an optimum avoidance or minimization of the edge drop is ensured even in rolled strips of different widths.

In order to achieve an optimum temperature drop in axial direction of the rolls in the strip edge area, it is proposed to direct the spray nozzle also onto those areas which contact the strip during rolling.

It is advantageous to supply the additional spray beams with spray medium which has a temperature which is different from, preferably lower than, the temperature of the spray medium for the other spray beams, wherein, for example, a common tank for the spray medium can be provided and the temperature of the spray medium can be adjusted to the temperature required for the other spray beams, while the spray medium for the additional spray beams is coolable through a controllable cooler.

It is advantageous to provide a regulating unit which operates as a forward regulating unit and in which predetermined strip data and/or strip data measured at the inlet side of the strip are utilized for selecting stored or computed, optimum values of spray widths, spray medium intensity and spray medium temperature and to utilize these values for the appropriate regulation.

It is also possible to provide a rearward control which includes a computer to which the thickness, the profile, particularly in the strip edge area, the width and/or the tension of the incoming strip are supplied and which determines with the aid of a computing model the optimum prestored spray widths, spray medium intensities and/or cooling medium temperatures.

A combination of forward control and rearward control is also conceivable.

The measurement results for the rearward control can be utilized for the advanced determination of the optimum values of spray widths, spray medium intensity and spray medium temperature and/or for an optimum influence of the control unit of the forward control. In the event that the measured values of the sensors or the predetermined strip data are not utilized for selecting from a storage unit the optimum values for the spray widths, spray medium intensities and/or cooling medium temperatures, a computer, which has available the corresponding functions for the respective optimum values of the spray widths, spray medium intensities and/or cooling medium temperatures, can with the aid of these measurement results compute the optimum values for the control elements of the regulating unit.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DESCRIPTION OF THE PREFERRED EMBODIMENTS

Figure 1:
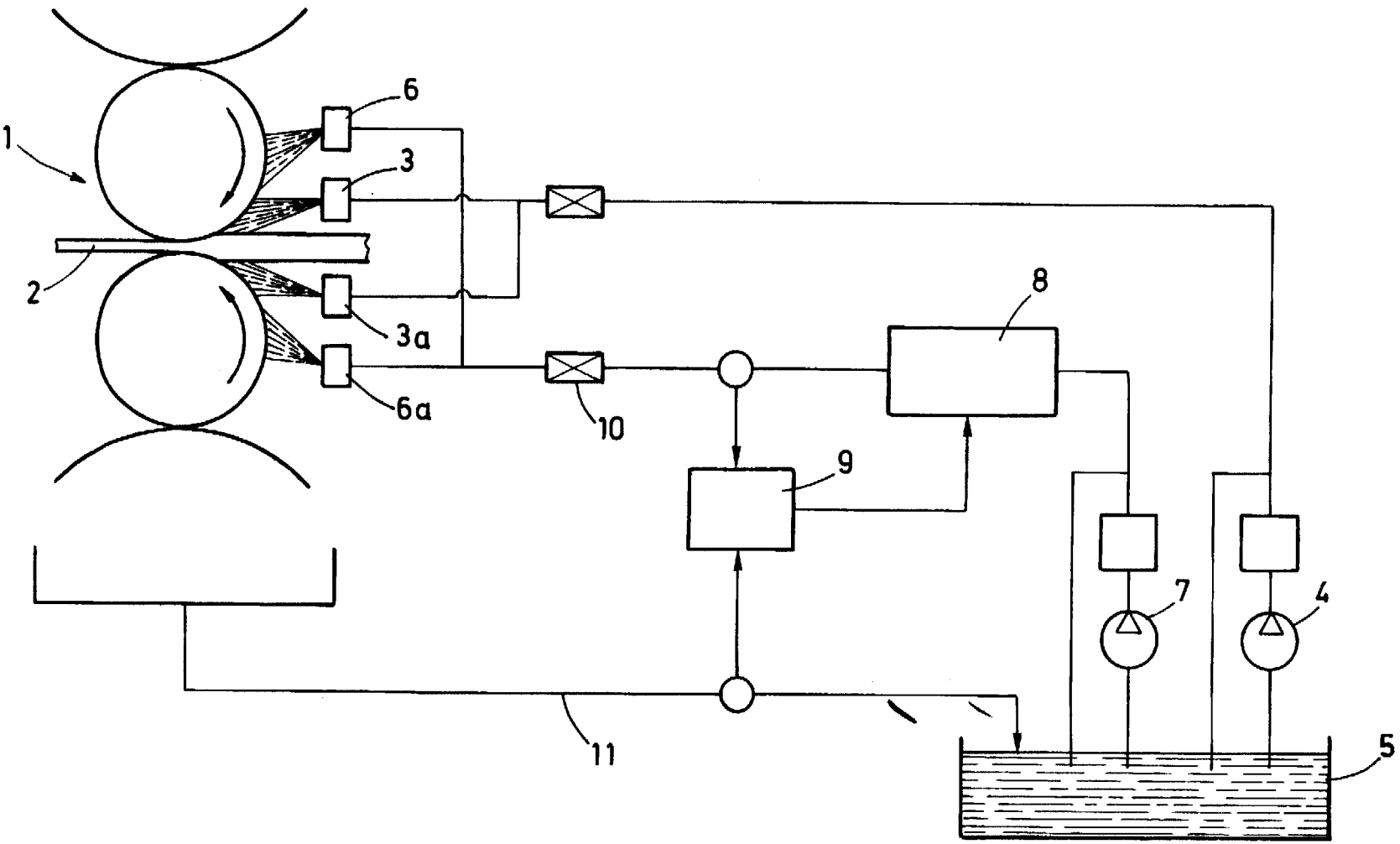
FIG. 1 is a schematic illustration of a roll stand with cooling units according to the present invention arranged at the work rolls on the inlet side of the strip.

FIG. 1 of the drawing shows a roll stand 1 for rolling strip 2, wherein spray beams 3, 3*a* for cooling medium and/or lubricating medium are provided at the entry side of the roll stand 1. The spray beams 3, 3*a* are provided with cooling medium and/or lubricating medium through a pump 4 from a tank 5.

Additional spray beams 6, 6*a* are directed toward the end areas of the bodies of the rolls. The additional spray beams 6, 6*a* are also supplied through a pump 7 from a tank 5. The spray medium is conducted through a cooling unit 8 which is capable of regulating in an optimum manner the temperature of the spray medium by means of a temperature regulator 9 in accordance with values predetermined by a computer, not shown.

The spray width and spray intensity of the additional spray beams 6, 6*a* can be adjusted through valves 10. The spray medium is collected and conducted through a return line 11 into the common tank 5. Of course, it is possible to provide separate tanks for the two spray media having different temperatures. In that case, the spray media are advantageously collected separately.

Figure 2A:
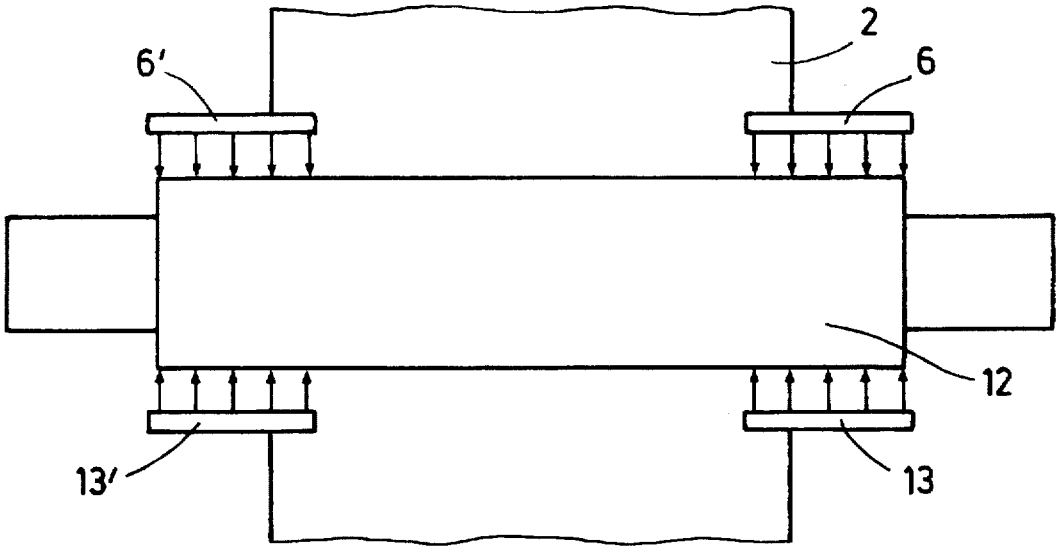
FIG. 2*a* shows the arrangement of the additional spray beams in the case of wide strip on the strip entry side and on the strip exit side.

FIG. 2*a* shows a work roll 12 for rolling wide strip 2. The additional spray beams 6, 6' can be seen on the strip entry side and the additional spray beams 13, 13' can be seen on the strip exit side, wherein the effective width of the spray beams is adjusted to the width of the rolled strip 2 and wherein the additional spray beams extend over narrow areas of the work rolls 12 which are in contact with the strip edges.

Figure 2B:
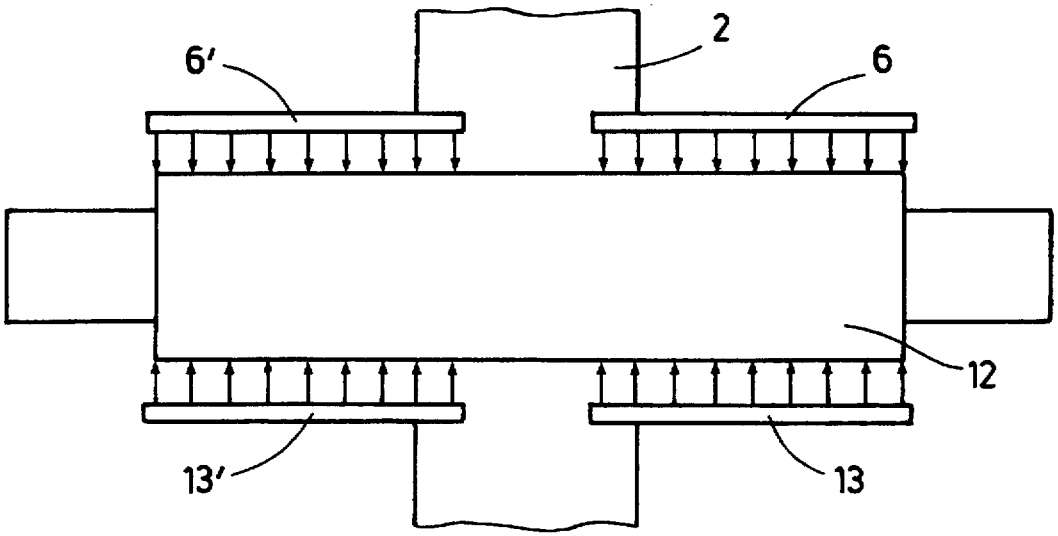
FIG. 2*b* shows the arrangement of the additional spray beams in the case of narrow strip on the strip entry side and on the strip exit side.

FIG. 2*b*, on the other hand, shows a narrow strip 2 and spray beams 6, 6'; 13, 13' whose effective widths are adjusted accordingly.

Figure 3:
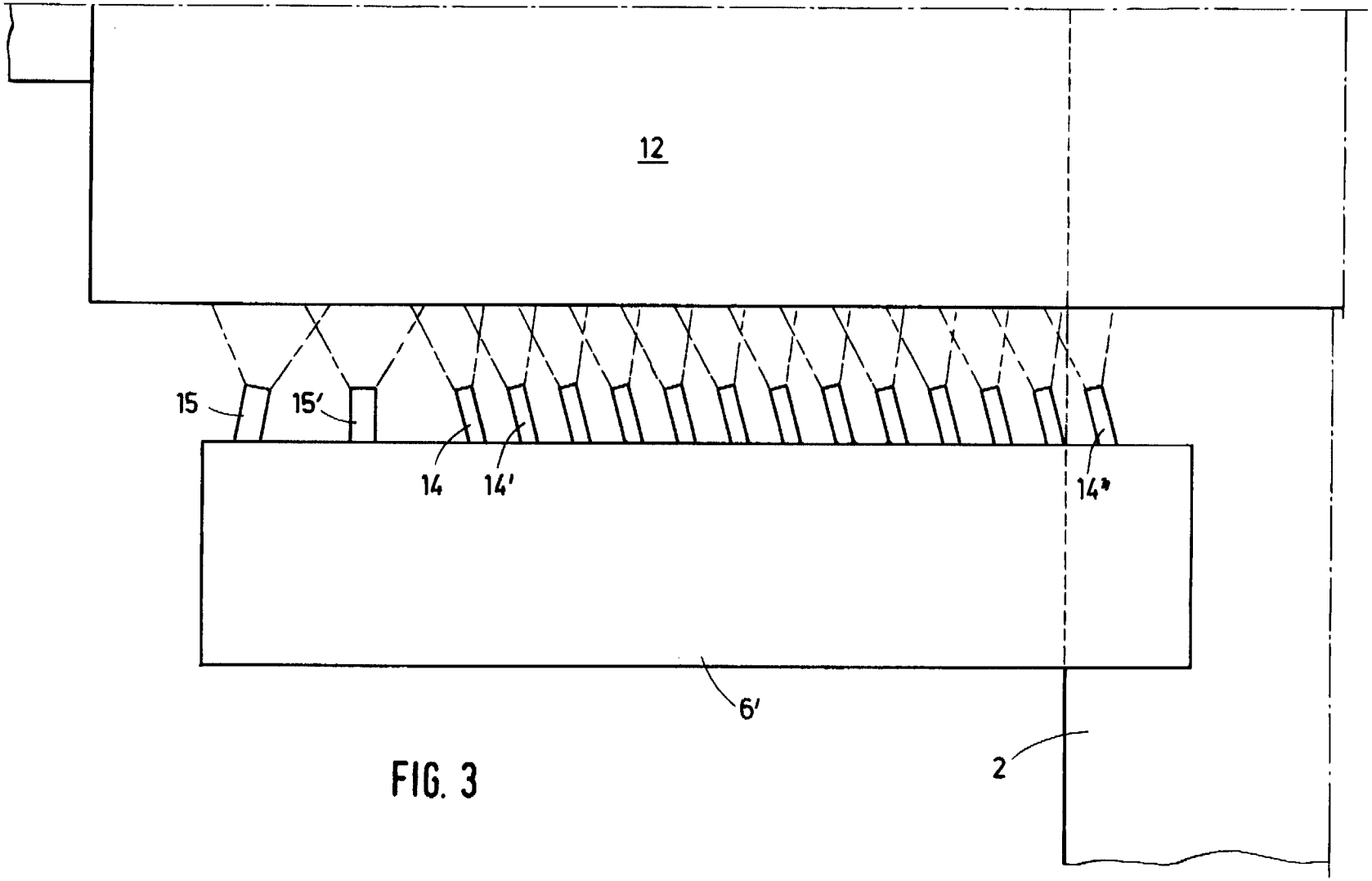
FIG. 3 is a partial view, on a larger scale, of a nozzle arrangement of an additional spray beam shown on a stand half.

FIG. 3 shows the spray beam 6' whose nozzles 14–14" are directed in the direction toward the end of the body of the work roll 12. Only the outermost nozzles 15, 15' are directed into a different spray direction.

The nozzles 14–14" and 15, 15' can be switched on and off individually, so that the spray width can be adjusted to the width of the strip to be rolled.

Figure 4A:
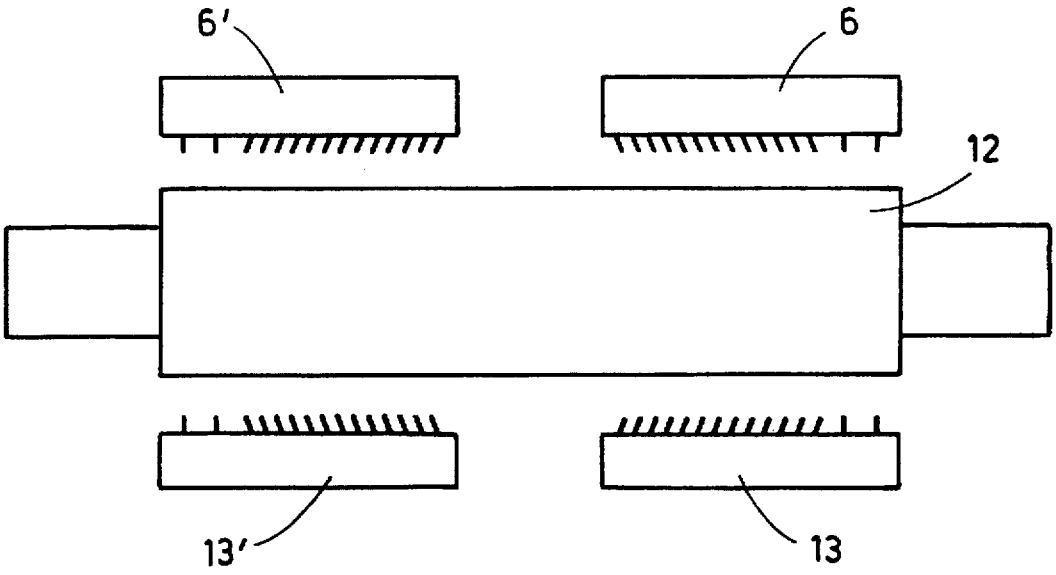
FIGS. 4*a*, 4*b* show differently constructed additional spray beams provided on the entry side and the exit side of the work roll.

Similar to FIG. 2*a*, FIG. 4*a* shows the spray beams 6, 6' on the strip entry side and the spray beams 13, 13' on the strip exit side, wherein the width of the spray beams 6, 6' and 13, 13' is selected in such a way that they are capable of cooling in an optimum manner the bodies of the work rolls 12 in a strip edge contact area of a minimum strip width to a maximum strip width.

Figure 4B:
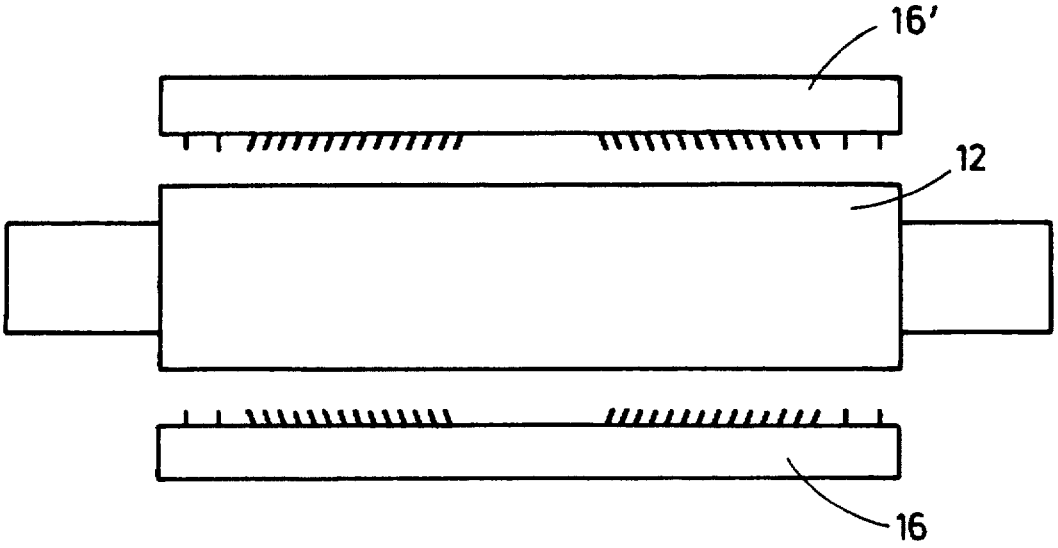

FIG. 4*b* shows a spray beam 16 on the strip entry side and a spray beam 16' on the strip exit side. Also in this case, it is ensured that an optimum adjustment of the cooling width in dependence on the strip width is possible.

Figure 5:
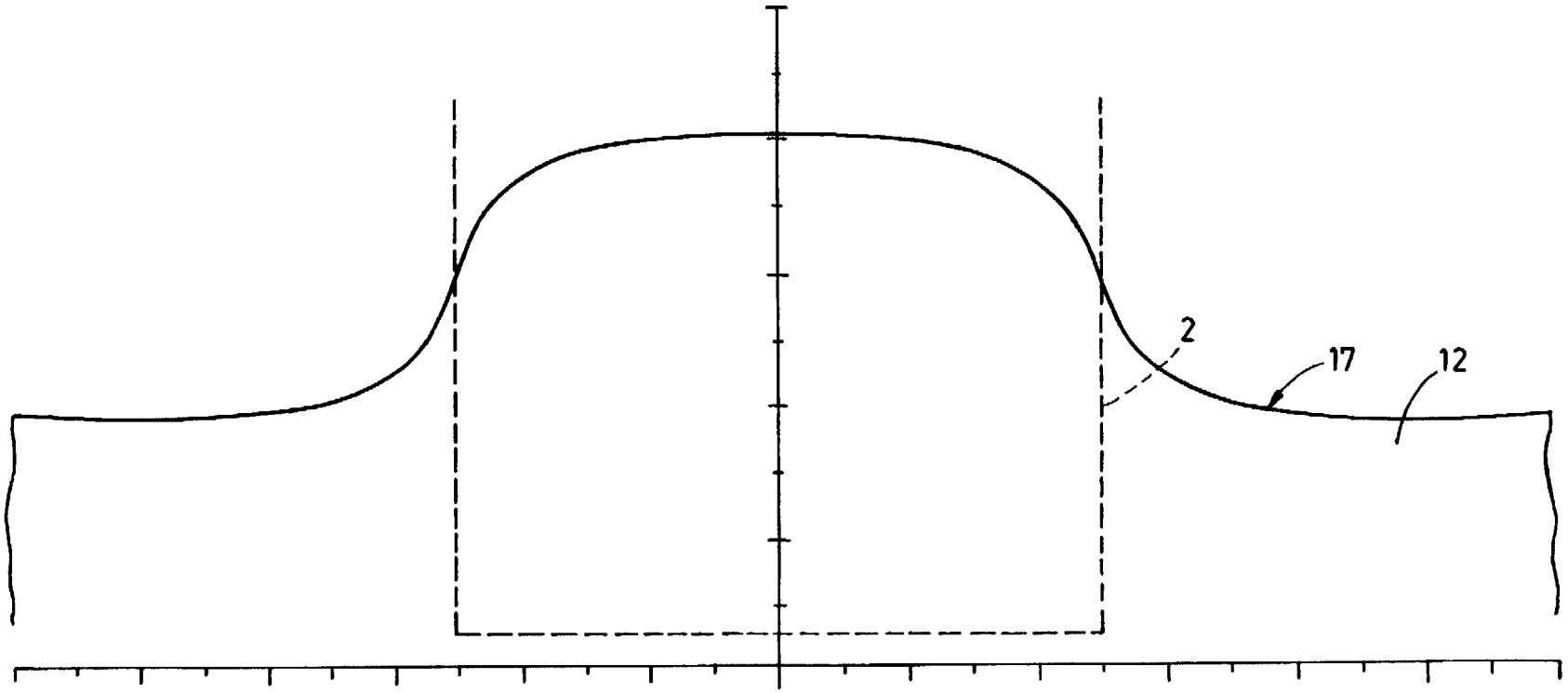
FIG. 5 is a partial view showing the body contour of a work roll without additional cooling.

FIG. 5 of the drawing shows the contour 17 of the body of the work roll 12 after an approximately 60 minute rolling process, wherein the additional spray beams 6, 6'; 13, 13'; 16, 16' did not supply spray medium to the roll surface. The usual thermal crown has been formed. A slow drop of the crown can be seen in the strip edge contact area. This slow drop of the crown is not capable of preventing the edge drop formation in the strip edge area caused by the transverse flow behavior of the material.

Figure 6:
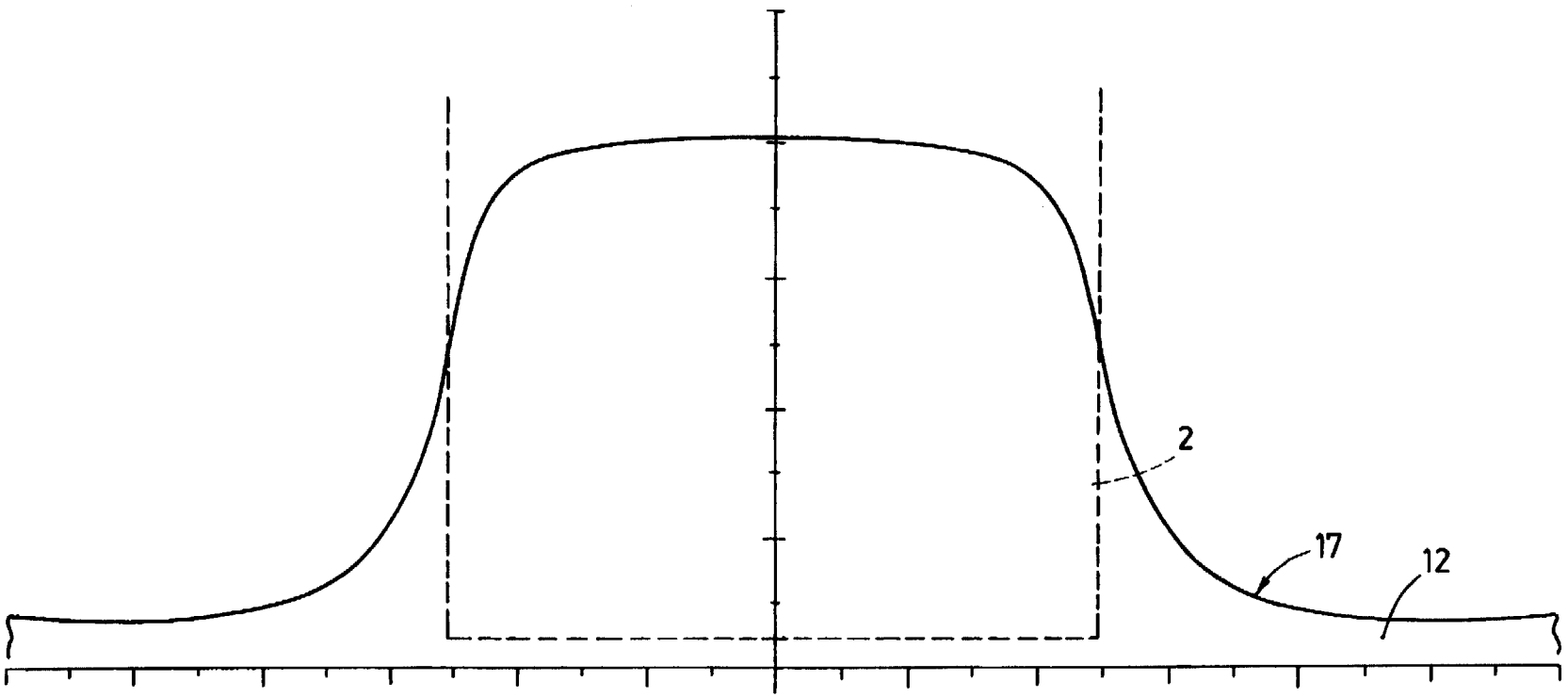
FIG. 6 is a partial view showing the body contour of a work roll with additional cooling.

FIG. 6 shows a body contour corresponding to that in FIG. 5. However, in FIG. 6, the additional spray beams 6, 6'; 13, 13'; 16, 16' supplied spray medium to the roll surface. The significant crown drop in the strip edge contact area is adjusted by additional cooling in such a way that the edge drop caused by the transverse flow behavior of the material can be reduced or minimized.

Figure 7:
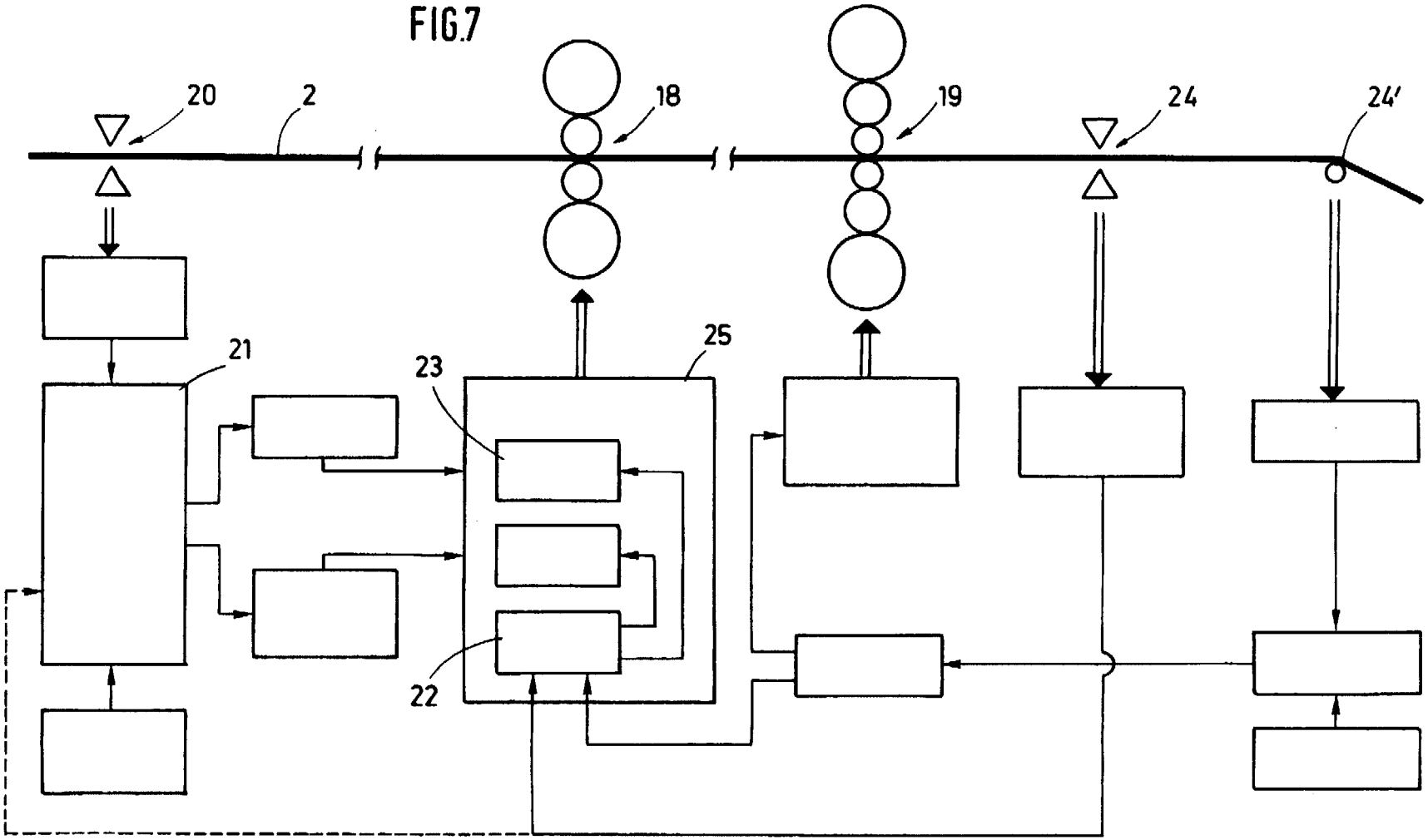
FIG. 7 is the control diagram for the edge drop control.

FIG. 7 is a schematic illustration of the regulating device according to the present invention. FIG. 7 shows the strip 2 which is cold rolled by a number of stands. FIG. 7 shows a four-high stand 18 which is provided with the edge drop control according to the invention, while a six-high stand 19 is shown with the conventional planeness control. Of course, the edge drop control according to the invention can also be assigned to several or all stands of a rolling train. Sensors 20 are provided at the entry side of the strip for determining the thickness, the strip profile particularly in the strip edge area, the width and/or the strip tension distribution. The measured values are compared through a computer 21 with stored values, wherein the optimum cooling water values are also stored in the computer 21. The read-out cooling water temperatures as well as the signals for the nozzle control are supplied to the cooling medium temperature control circuit 22 or the nozzle supply control circuit 23.

Sensors 24, 24', provided alternatively or in addition to the sensors 20, also measure the strip profile particularly in the strip edge area, the strip width and the strip tension distribution. These measurement results are supplied to the control unit 25 which corrects the measured values to an optimum spray width, spray medium intensity and cooling medium temperature. These measurement results can additionally be used for correcting the values stored in the computer 21.

While specific embodiments of the invention have been shown and described in detail to illustrate the inventive principles, it will be understood that the invention may be embodied otherwise without departing from such principles.

We claim:

1. A device for influencing a strip profile of a strip rolled in at least one roll stand having rolls, each roll having a roll body with two ends and end portions adjacent each end, the device comprising at least one of adjusting units, bending units and displacement units for the rolls of the at least one roll stand and spray beams including spray means for spraying at least one of cooling medium and lubricating medium onto the rolls, the device further comprising additional spray beams including spray means, the additional spray beams being arranged adjacent the two end portions of the body of each roll, wherein each additional spray beam has an effective range extending between one of the ends of the body of the roll and an area of a strip edge facing said end of the body of the roll.

2. The device according to claim 1, wherein the additional spray beams are provided only for work rolls of the at least one roll stand.

3. The device according to claim 1, wherein the additional spray beams are mounted at least one of on an entry side and on an exit side of the at least one roll stand.

4. The device according to claim 1, wherein the spray means of the additional spray beams are spray nozzles, the spray nozzles having a spraying direction including a component directed toward the end portion of the body of the roll.

5. The device according to claim 4, comprising means for adjusting a width of operation of the spray nozzles of the additional spray beams to a width of the rolled strip.

6. The device according to claim 4, wherein the spray nozzles of the additional spray beams are directed toward the roll along an area extending from one of the end portions of the body of the roll and by a predetermined extent over a strip edge facing said end portion of the body of the roll.

7. The device according to claim 1, comprising means for supplying a spray medium having a temperature to the spray beams and means for supplying a spray medium at a temperature to the additional spray beams, wherein the temperature of the spray medium supplied to the spray beams is different from the temperature of the spray medium supplied to the additional spray beams.

8. The device according to claim 1, comprising a regulating unit for influencing the rolled strip profile, comprising measuring means at an entry side of the at least one roll stand for measuring a thickness of the strip, the profile in a strip edge area, a width of the strip and a tension of the entering rolled strip, and a computer for determining in accordance with measurement results provided by the measuring means optimum prestored spray widths, spray medium intensities and cooling medium temperatures.

9. The device according to claim 8, wherein the computer comprises means for computing at least one of optimum spray widths, spray medium intensities and cooling medium temperatures.

10. The device according to claim 1, comprising a regulating unit for influencing the rolled strip profile, the device comprising a computer for receiving values for at least one of the thickness, the profile in the strip edge area, a width and a tension of the entering strip and for determining with a computing model at least one of optimum prestored spray widths, spray medium intensities and cooling medium temperatures.

11. The device according to claim 1, comprising measuring means at an exit side of the at least one roll stand for measuring the profile in the strip edge area, a width and a strip tension distribution of the rolled strip and means for supplying measurement values to the regulating unit for correction of at least one of optimum spray width, spray medium intensity and/or cooling medium temperature.

12. The device according to claim 11, comprising means for utilizing the strip tension distribution for controlling strip tension.

13. The device according to claim 11, comprising means for utilizing the measurement values at the exit side of the at least one roll stand for correcting a computing process in the computer.

* * * * *